US010932055B2

(12) United States Patent
Zhang

(10) Patent No.: US 10,932,055 B2
(45) Date of Patent: Feb. 23, 2021

(54) SPEAKER

(71) Applicant: AAC Technologies Pte. Ltd., Singapore (SG)

(72) Inventor: Guqing Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,194

(22) Filed: Jul. 29, 2019

(65) Prior Publication Data

US 2020/0045461 A1 Feb. 6, 2020

(30) Foreign Application Priority Data

Aug. 1, 2018 (CN) ..... 201821236945.3

(51) Int. Cl.

| | |
|---|---|
| ***H04R 9/06*** | (2006.01) |
| ***H01R 13/24*** | (2006.01) |
| ***H04R 7/18*** | (2006.01) |
| ***H04R 9/02*** | (2006.01) |

(52) U.S. Cl.

CPC ..... *H04R 9/06* (2013.01); *H01R 13/2407* (2013.01); *H01R 13/2464* (2013.01); *H04R 7/18* (2013.01); *H04R 9/025* (2013.01); *H04R 2400/11* (2013.01)

(58) Field of Classification Search

CPC ..... H04R 9/046; H04R 9/025; H04R 9/06; H04R 9/02; H04R 7/127; H04R 7/18; H04R 2400/11; H04R 2307/021; H04R 2307/029; H01R 13/08; H01R 13/11; H01R 13/10; H01R 13/14; H01R 13/20; H01R 13/24; H01R 13/2407; H01R 13/2414

See application file for complete search history.

(56) References Cited

U.S. PATENT DOCUMENTS

2012/0177244 A1* 7/2012 Liu ..... H04R 7/18 381/396

FOREIGN PATENT DOCUMENTS

CN 209390329 U * 9/2019

* cited by examiner

*Primary Examiner* — Sunita Joshi
(74) *Attorney, Agent, or Firm* — W&G Law Group LLP

(57) ABSTRACT

Provided is a speaker, including a holder, a pad fitted in the holder, and a conductive terminal. The conductive terminal comprises a fixed portion fitted into the holder, an elastic arm, and an engaging portion, an electrical connection portion. The elastic arm comprises an arc-shaped conductive portion connected to the fixed portion, and an extending portion connecting the arc-shaped conductive portion and the electrical connection portion. The arc-shaped conductive portion is spaced apart from the holder and protruding from the holder, the extending portion extends from the arc-shaped conductive portion towards the holder, and an end of the extending portion facing away from the arc-shaped conductive portion is attached to the holder. The engaging portion extends from an edge of an end of the extending portion facing away from the arc-shaped conductive portion while being bent towards the holder, and is engaged in an engaging groove of the holder.

10 Claims, 3 Drawing Sheets

SPEAKER

TECHNICAL FIELD

The present disclosure relates to the field of electroacoustic transformation, and in particular, to a speaker having a high reliability and produced automatically.

BACKGROUND

With the rapid development of technologies, audio devices become more and more popular, and among numerous recreation modes, high-quality music enjoyment is gradually popularized. Thus, speakers for playing audio have been widely applied to existing smart mobile devices.

The speaker in the related art includes a holder, an upper cover matching the holder to form a receiving space, a vibration unit received in the receiving space and including a diaphragm and a voice coil, a magnetic circuit unit for driving the diaphragm to vibrate and emit sound, a pad fitted in an end of the holder facing away from the upper cover and configured to electrically connect the voice coil to an external circuit, and a conductive terminal matching the pad.

However, in the speaker of the related art, the structure of the conductive terminal is fixed, so that the length of an elastic arm of the conductive terminal cannot be adjusted. Therefore, the conductive terminals have to be specifically designed for products in different sizes, and during the production process of the speaker, since a hook of the conductive terminal is not fixed, there is a risk that the holder might detach.

Therefore, it is urgent to provide a new speaker to overcome the above defects.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
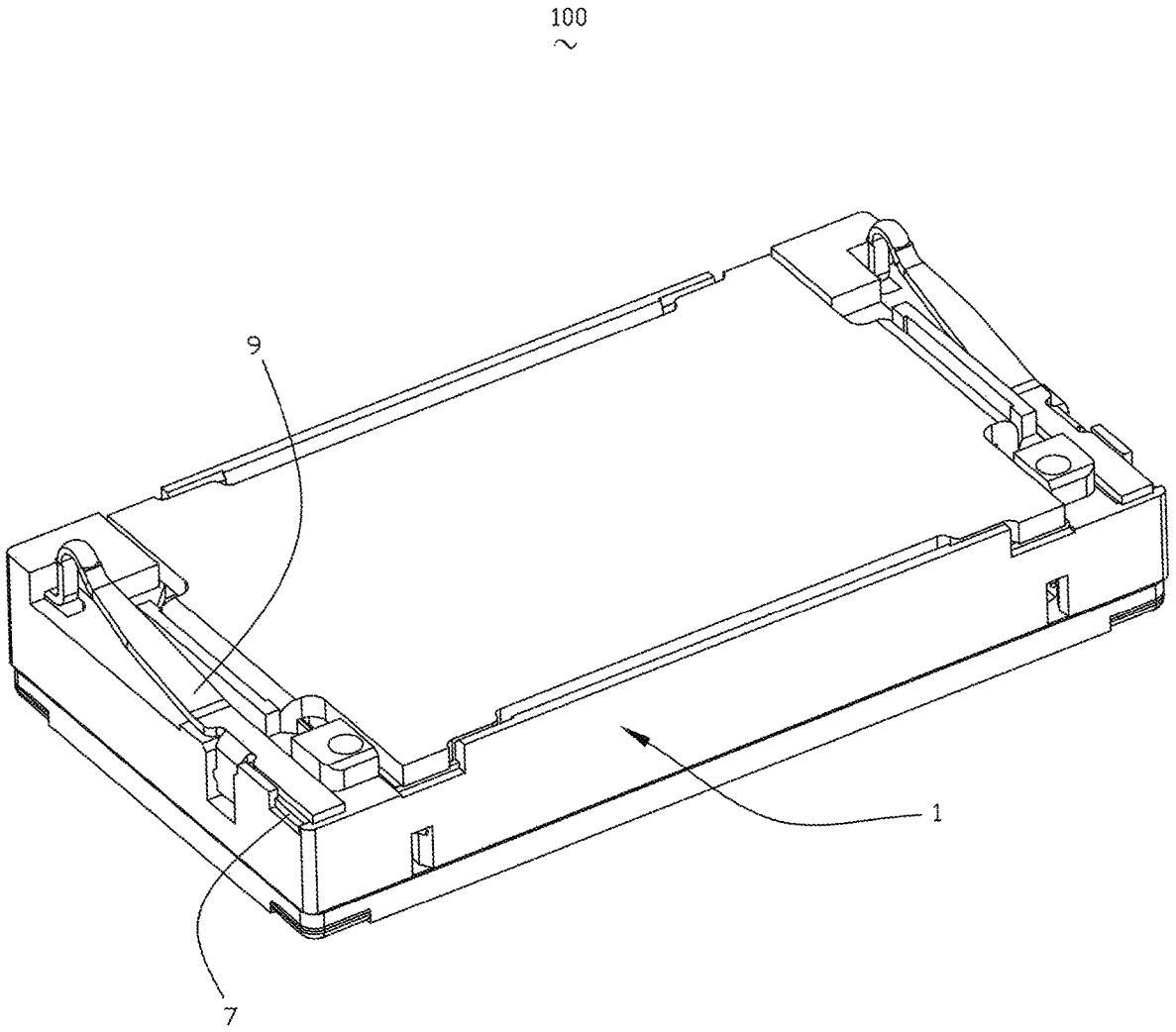
FIG. 1 is a perspective schematic assembly diagram of a speaker according to the present disclosure.
Figure 2:
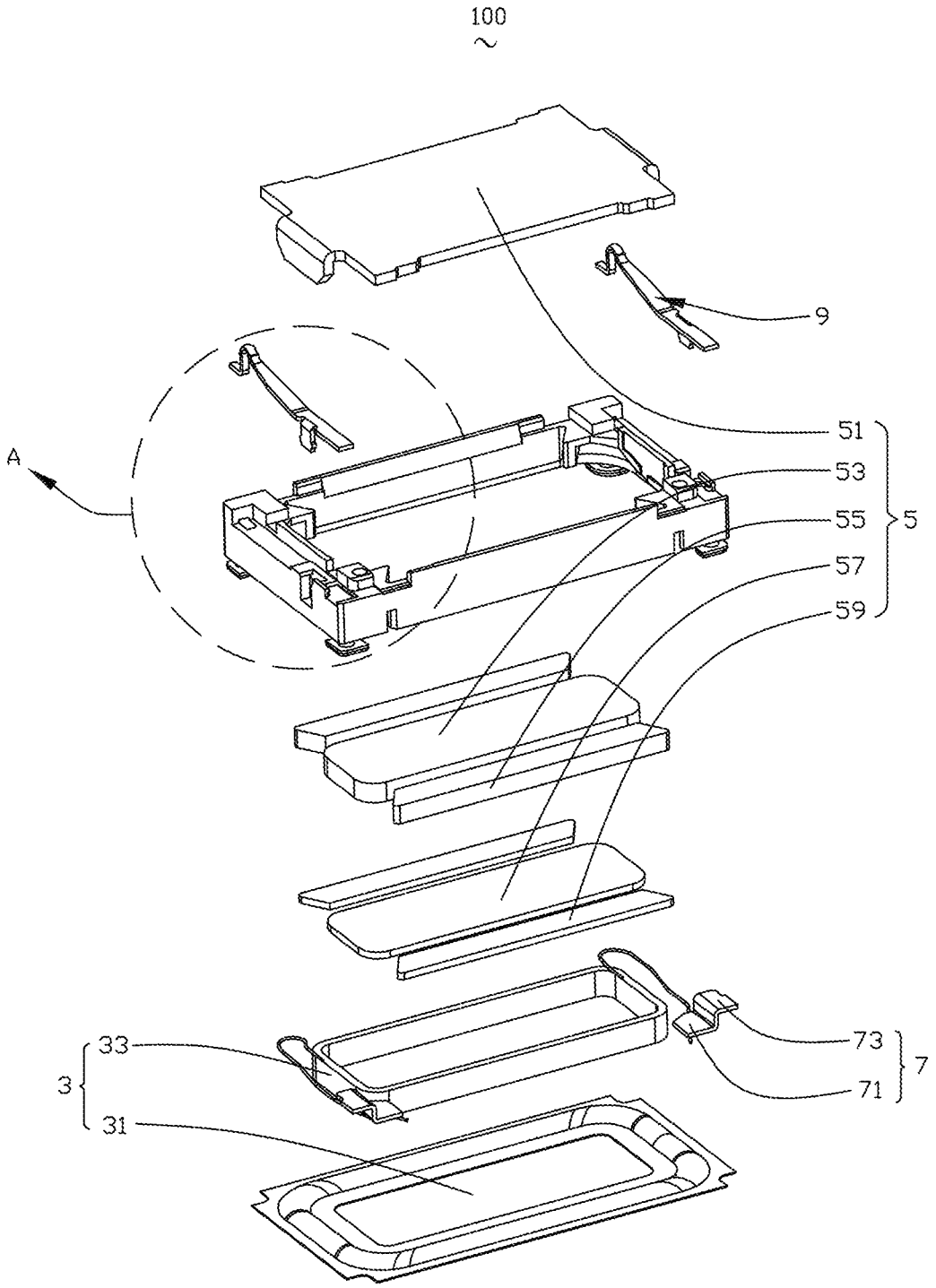
FIG. 2 is a perspective exploded view of the speaker shown in FIG. 1.
Figure 3:
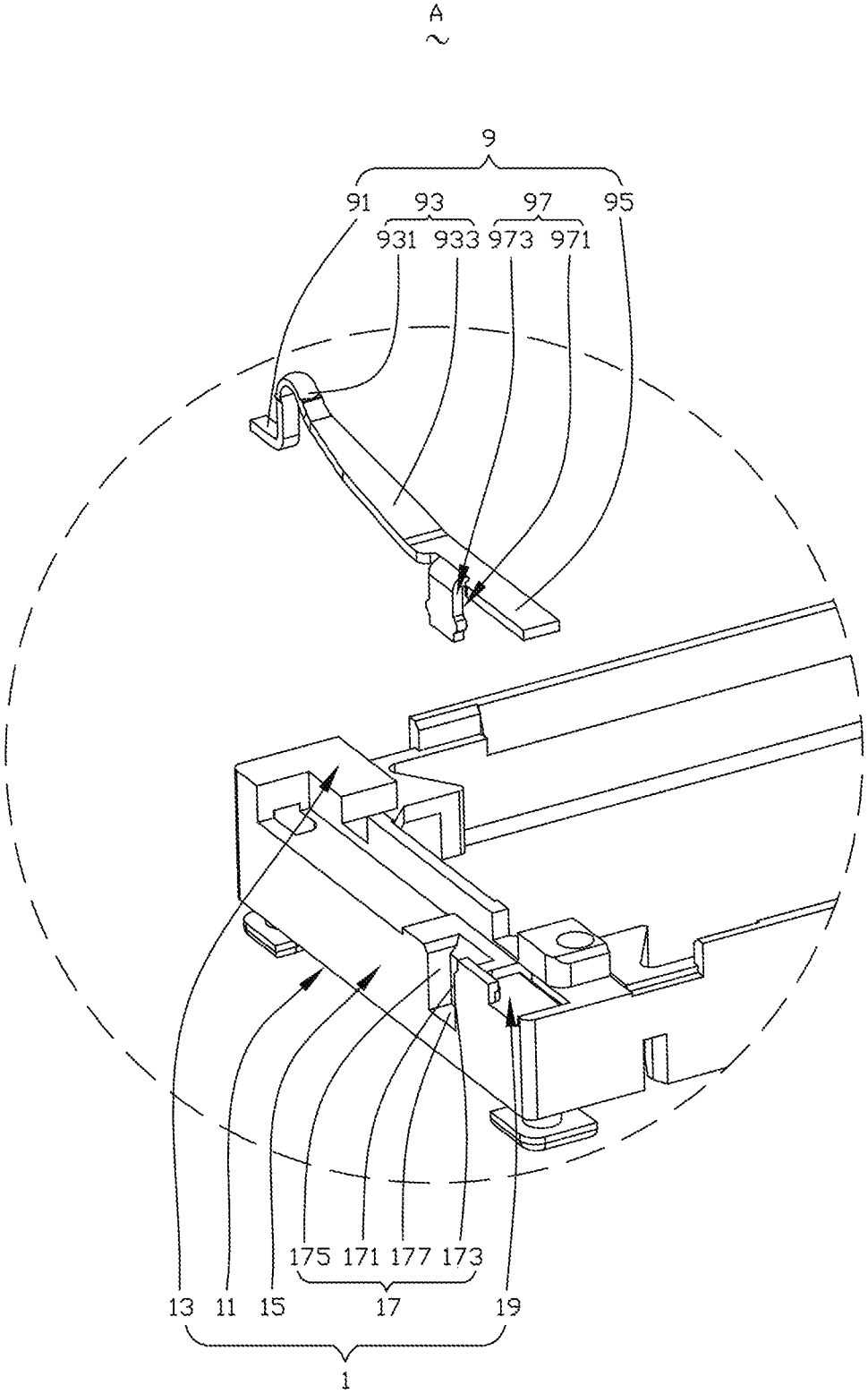
FIG. 3 is an enlarged view of a portion A of the speaker shown in FIG. 2.

Referring to FIG. 1 to FIG. 3, the speaker 100 includes a holder 1 having a receiving space, a vibration unit 3 and a magnetic circuit unit 5 that are received in the holder 1, pads 7 fitted in the holder 1 and partially exposed out of the holder 1, and conductive terminals 9 connected to the pad 7. The vibration unit 3 includes a diaphragm 31 fixed to a side of the holder 1 and a voice coil 33 for driving the diaphragm 31 to vibrate, and the pad 7 is electrically connected to the voice coil 33.

The holder 1 is a rectangular frame. The holder 1 includes a bottom wall 11 for fixing the diaphragm 31, a top wall 13 opposite to the bottom wall 11, an outer sidewall 15 connecting the bottom wall 11 with the top wall 13, an engaging groove 17 formed by recessing from the top wall 13 towards the bottom wall 11, and a receiving groove 19 formed, corresponding to the pad 7, by recessing from the top wall 13 towards the bottom wall 11. The receiving groove 19 is used for receiving the pad 7, and the engaging groove 17 and the receiving groove 19 are arranged at two opposite ends of the top wall 13 along a length direction of the holder 1.

In order to ensure a reliable connection between the pad 7 and the conductive terminal 9, the top wall 13 is designed to expose at least a part of the pad 7.

The engaging groove 17 includes a first surface 171 close to the receiving space, a second surface 173 extending from a side of the first surface 171 close to the receiving groove 19 while being bent in a direction facing away from the receiving space, a third surface 175 extending from a side of the first surface 171 facing away from the receiving groove 19 while being bent in the direction facing away from the receiving space, and a fourth surface 177 extending from a side of the first surface 171 close to the diaphragm 31 while being bent in the direction facing away from the receiving space. The second surface 173 and the third surface 175 are disposed opposite to one another. The second surface 173, the third surface 175, and the fourth surface 177 extend to the outer sidewall 15.

The magnetic circuit unit 5 includes a yoke 51 fixed to and held at the holder 1, a main magnet 53 assembled at the center of the yoke 51, auxiliary magnet 55 disposed at sides of the main magnet 53, a main pole core 57 attached to the surface of the main magnet 53, and auxiliary pole cores 59 attached to the surface of the auxiliary magnets 55.

The pad 7 includes a first conductive portion 71 extending into the receiving space through the receiving groove 19, and a second conductive portion 73 extending from the first conductive portion 71 while being bent and partially exposed to the holder 1. The first conductive portion 71 is electrically connected to the voice coil 33.

The number of the pads 7 is two, and the two pads 7 are respectively fitted in two sides of the holder in a length direction, and are symmetrically arranged with respect to a central axis in a length direction of the speaker 100.

Correspondingly, the number of the conductive terminals 9 is also two, and the two conductive terminals 9 are respectively disposed correspondingly to the pads 7.

The conductive terminal 9 includes a fixed portion 91 fixed to and fitted in the holder 1, an elastic arm 93 extending from the fixed portion 91 in a direction facing away from the holder 1, an electrical connection portion 95 extending from the elastic arm 93 in a direction facing way from the fixed portion 91, and an engaging portion 97 extending from an edge of an end of the elastic arm 93 facing away from the fixed portion 91 while being bent towards the holder 1.

The elastic arm 93 includes an arc-shaped conductive portion 931 fixedly connected to the fixed portion 91 and an extending portion 933 connecting the arc-shaped conductive portion 931 with the electrical connection portion 95.

The arc-shaped conductive portion 931 is spaced apart from the holder 1 and protrudes from the outside of the holder 1.

The extending portion 933 extends from the arc-shaped conductive portion 931 in a direction facing towards the holder 1, and an end of the extending portion facing away from the arc-shaped conductive portion 931 is attached to the holder 1.

The electrical connection portion 95 is electrically connected to the pad 7. Specifically, the electrical connection portion 95 and the pad 7 are fixed by laser welding.

The engaging portion 97 is disposed correspondingly to the engaging groove 17, and the engaging portion 97 is engaged into the engaging groove 17.

For example, the engaging portion 97 includes a matching surface 971 opposite to the first surface 171 and an abutting surface 973 extending from the matching surface 971 towards the second surface 173 and the third surface 175 and abutting against the second surface 173 and the third surface 175. The engaging portion 97 is engaged into the engaging groove 17 through the abutting surface 973. For example, the abutting surface 973 has a protrusion, and the abutting surface abuts against the second surface 173 and the third surface 175 through the protrusion.

Compared with the related art, the speaker 100 provided by the present disclosure provides the elastic arm 93. Due to the structure of the elastic arm 93, i.e., the extending portion 933 extends from the arc-shaped conductive portion 931 in the direction facing towards the holder 1, and the end of the extending portion 933 facing away from the arc-shaped conductive portion 931 is attached to the holder 1, the speaker 100 can change the length of the conductive terminal 9 by changing a bending angle of the extending portion 933, thereby changing the elastic force of the conductive terminal 9. Meanwhile, by providing the fixed portion 91 fixed to and fitted into the holder 1, the fixed portion 91 is unlikely to be popped out, the positioning is more stable, and the assembly is simplified, thereby facilitating the fully automated production of the speaker 100.

The description above is only implementations of the present disclosure, and it should be noted that those of ordinary skill in the art can make improvements without departing from the innovative concept of the present disclosure, and these improvements all fall within the protection scope of the present disclosure.

What is claimed is:

1. A speaker, comprising:

a holder having a receiving space;

a pad embedded in the holder and partially exposed out of the holder; and a conductive terminal connected to the pad, wherein the conductive terminal comprises:

a fixed portion fixed to and fitted into the holder;

an elastic arm extending from the fixed portion in a direction facing away from the holder;

an electrical connection portion extending from the elastic arm in a direction facing towards the pad; and an engaging portion, wherein the electrical connection portion is electrically connected to the pad, the elastic arm comprises an arc-shaped conductive portion connected to the fixed portion, and an extending portion connecting the arc-shaped conductive portion with the electrical connection portion, the arc-shaped conductive portion being spaced apart from the holder and protruding from the holder, the extending portion extending from the arc-shaped conductive portion in a direction facing towards the holder, and an end of the extending portion facing away from the arc-shaped conductive portion being attached to the holder, the engaging portion extends from an edge of an end of the extending portion facing away from the arc-shaped conductive portion in the direction facing towards the holder, the holder is provided with an engaging groove corresponding to the engaging portion, and the engaging portion is engaged into and fixed to the engaging groove;

wherein the speaker further comprises a vibration unit and a magnetic circuit unit that are received in the holder, the vibration unit comprises a diaphragm fixed to a side of the holder and a voice coil configured to drive the diaphragm to vibrate, and the pad is electrically connected to the voice coil.

2. The speaker as described in claim 1, wherein the holder comprises a bottom wall for fixing the diaphragm, a top wall opposite to the bottom wall, and an outer sidewall connecting the bottom wall with the top wall, the pad being at least partially exposed on the top wall, and the engaging groove is formed by recessing from the top wall towards the bottom wall.

3. The speaker as described in claim 2, wherein a receiving groove is formed, corresponding to the pad, by recessing from the top wall towards the bottom wall, and the pad is received in the receiving groove.

4. The speaker as described in claim 3, wherein the pad comprises a first conductive portion extending into the receiving space through the receiving groove, and a second conductive portion extending from the first conductive portion while being bent and partially exposed on the holder, the voice coil being electrically connected to the first conductive portion.

5. The speaker as described in claim 4, wherein the engaging groove comprises:

a first surface close to the receiving space;

a second surface extending from a side of the first surface close to the receiving groove while being bent in a direction facing away from the receiving space;

a third surface extending from a side of the first surface facing away from the receiving groove while being bent in the direction facing away from the receiving space; and a fourth surface extending from a side of the first surface close to the diaphragm while being bent in the direction facing away from the receiving space, the second surface and the third surface being disposed opposite to one another, and the second surface, the third surface, and the fourth surface extending to the outer sidewall.

6. The speaker as described in claim 5, wherein the engaging portion comprises a matching surface opposite to the first surface, and an abutting surface extending from the matching surface towards the second surface and the third surface and abutting against the second surface and the third surface, the engaging portion being engaged in the engaging groove through the abutting surface.

7. The speaker as described in claim 1, wherein the electrical connection portion and the pad are fixed by laser welding.

8. The speaker as described in claim 1, wherein the holder is a rectangular frame, two pads are provided, and the two pads are respectively embedded at two sides of the holder along a length direction and are symmetrically arranged with respect to a central axis of a length direction of the speaker.

9. The speaker as described in claim 8, wherein two conductive terminals are provided, and the two conductive terminals are disposed correspondingly to the two pads, respectively.

10. The speaker as described in claim 6, wherein the abutting surface is provided with a protrusion.

* * * * *